US007132784B2

(12) United States Patent
Mohri et al.

(10) Patent No.: US 7,132,784 B2
(45) Date of Patent: Nov. 7, 2006

(54) FLUORESCENT DISPLAY TUBE HAVING PROVISION FOR PREVENTING SHORT-CIRCUIT THEREIN, AND METHOD OF MANUFACTURING THE SAME

(75) Inventors: Jun Mohri, Mii-gun (JP); Takahiro Nakano, Ogohri (JP); Akihiro Oku, Tosu (JP)

(73) Assignees: Noritake Co., Limited, Nagoya (JP); Noritake Electronics., Ltd., Asakura-gun (JP)

( * ) Notice: Subject to any disclaimer, the term of this patent is extended or adjusted under 35 U.S.C. 154(b) by 0 days.

(21) Appl. No.: 10/105,409

(22) Filed: Mar. 26, 2002

(65) Prior Publication Data

US 2002/0140340 A1 Oct. 3, 2002

(30) Foreign Application Priority Data

Mar. 30, 2001 (JP) ..... 2001-098925

(51) Int. Cl.
*H01J 1/62* (2006.01)

(52) U.S. Cl. ..... 313/484; 313/309; 313/495

(58) Field of Classification Search ..... 313/484, 313/513, 518, 519, 520, 220, 317, 515, 485, 313/585, 495–497, 292
See application file for complete search history.

(56) References Cited

U.S. PATENT DOCUMENTS 3,912,964 A * 10/1975 Kouyama et al. ..... 313/519
4,190,787 A * 2/1980 Kishino et al. ..... 313/494
4,423,352 A * 12/1983 Miyazaki et al. ..... 313/584
5,124,615 A * 6/1992 Kim ..... 313/485
5,568,012 A * 10/1996 Mohri et al. ..... 313/517
5,643,034 A * 7/1997 Mohri et al. ..... 445/24
5,663,611 A * 9/1997 Seats et al. ..... 313/584
5,739,799 A * 4/1998 Takahashi et al. ..... 345/68
5,744,909 A * 4/1998 Amano ..... 313/585
5,754,004 A * 5/1998 Miyagawa et al. ..... 313/585
5,861,713 A * 1/1999 Kondo et al. ..... 313/495
5,920,295 A * 7/1999 Takahashi et al. ..... 345/60
6,160,348 A * 12/2000 Choi ..... 313/584

(Continued)

FOREIGN PATENT DOCUMENTS

JP 6-251732 9/1994

(Continued)

*Primary Examiner*—Karabi Guharay
*Assistant Examiner*—Dalei Dong
(74) *Attorney, Agent, or Firm*—Oliff & Berridge, PLC

(57) ABSTRACT

A fluorescent display tube including: (a) a substrate having a display surface; (b) anodes formed on the display surface of the substrate, and spaced apart each other; (c) cathodes capable of generating electrons; (d) fluorescent layers each of which is fixed to a corresponding one of the anodes; (e) a rib formed on the display surface of the substrate so as to surround a periphery of each of the fluorescent layers; and (f) a control electrode fixed to an upper end face of the rib, and consisting of a plurality of sections which are spaced apart each other; wherein the fluorescent layers are selectively activated by the control electrode, so as to be struck by the electrons generated by the cathodes, for emitting light, wherein the rib includes continuous wall portions continuously extending along respective boundaries each of which is located between a corresponding pair of the anodes which are adjacent to each other, such that each pair of the anodes are electrically insulated from each other, and wherein the continuous wall portions include portions each of which extends between a corresponding pair of the sections of the control electrode which are adjacent to each other and which are spaced apart from each other.

8 Claims, 7 Drawing Sheets

U.S. PATENT DOCUMENTS 6,377,002 B1 * 4/2002 Ge et al. ..... 315/366
6,534,912 B1 * 3/2003 Takano et al. ..... 313/497
6,535,184 B1 * 3/2003 Yoon et al. ..... 345/47
6,734,618 B1 * 5/2004 Ku et al. ..... 313/495
6,787,978 B1 * 9/2004 Yura et al. ..... 313/483
6,803,716 B1 * 10/2004 Park et al. ..... 313/495

FOREIGN PATENT DOCUMENTS

JP 3102767 8/2000

* cited by examiner

FLUORESCENT DISPLAY TUBE HAVING PROVISION FOR PREVENTING SHORT-CIRCUIT THEREIN, AND METHOD OF MANUFACTURING THE SAME

BACKGROUND OF THE INVENTION

1. Field of the Invention

The present invention relates in general to improvements in a fluorescent display device and in a method of manufacturing the fluorescent display device.

2. Discussion of the Related Art

There is known a fluorescent display tube which includes: (a) a substrate having a display surface; (b) anodes formed on the display surface of the substrate and spaced apart each other; (c) fluorescent layers each of which is fixed to a corresponding one of the anodes; (d) filament cathodes located above the fluorescent layers to generate thermo electrons; and (e) a control electrode (grid electrode) located between the fluorescent layers and the cathodes, and consisting of a plurality of sections spaced apart each other. The control electrode serves to control activations of the fluorescent layers, such that the fluorescent layers are selectively activated, namely, emit glow or light when they are struck by the thermo electrons in a vacuum space. This type of fluorescent display tube is capable of providing a clear image with a relatively low voltage to accelerate the electrons, owing to the arrangement in which the fluorescent layers are positioned in the vicinity of the cathodes which generate the electrons toward the fluorescent layers. Further, the use of different fluorescent materials for the fluorescent layers which emit lights of different colors permits a color display of images. Therefore, the fluorescent display tube is widely used as display devices on acoustic devices and on instrument panels of motor vehicles or airplanes. Particularly, in such a fluorescent display tube having, in place of a so-called "mesh-grid structure" in which the grid electrodes are provided by meshes covering the fluorescent layers, a so-called "rib-grid structure" in which the grid electrodes are provided by conductive films fixed to upper end face of a partition or rib that surrounds the fluorescent layers and that has a larger height than the fluorescent layers, the grid electrodes are unlikely to suffer from thermal deformations even where the size of each grid electrode is increased in the interest of increasing the overall size or area of the display screen, thereby making it possible to prevent a problem such as instable luminance of the fluorescent layers and short-circuiting which would be caused by the thermal deformations of the grid electrodes. Further, while the luminance of the fluorescent layers is problematically reduced depending upon an opening ratio of the meshes in the fluorescent display tube having the mesh-grid structure, such a problem no longer exists in the fluorescent display tube having the rib-grid structure in place of the mesh-grid structure.

The fluorescent display tube having the above-described rib-grid structure is generally produced in the following manner:

That is, the rib is formed in such a manner that permits the rib to surround the anodes which have been fixed to the display surface of the substrate. After the formation of the rib, the fluorescent layers are fixedly formed on the anodes in accordance with a suitable method such as a thick-film screen printing method in which a fluorescent paste is dropped into recesses or cells defined by the rib. After the formation of the fluorescence layers, the grid electrode is fixedly formed on the upper end face of the rib in accordance with a suitable method such as a thick-film screen printing method in which a conductor paste is applied to the upper end surface of the rib. In this instance, it is desirable to minimize the width of each wall of the rib, for minimizing the surface area of a non-display portion of the display screen, to such an extent that still permits the grid electrode to be formed on the rib. In view of this, the rib and the grid electrode are formed by using the same screen printing pattern, for equalizing the width of the rib and the width of the grid electrode to each other.

Where such a fluorescent display tube is designed for graphical representations, the plurality of fluorescent layers are arranged in the longitudinal and width directions of the substrate with high density, for forming a desired image in a matrix of dots. It is desirable that the spacing interval between each adjacent pair of the fluorescent layers is minimized for thereby improving the quality of the formed image. Therefore, between each adjacent pair of the fluorescent layers, there is provided only a single grid electrode for serving commonly for both of the adjacent pair of the fluorescent layers. However, in such a arrangement, each fluorescent layer can not be surrounded at its entire periphery by the grid electrode, namely, a certain amount of gap has to be provided in the grid electrode so that the grid electrode is constituted by a plurality of sections which are spaced apart each other with the certain amount of gap between each adjacent pair of the plurality of sections. As long as the rib and the grid electrode are formed by using the same screen printing pattern, the provision of the gap in the grid electrode leads to the provision of a gap 82 in the rib 80, as shown in FIGS. 1A and 1B. As a result, the fluorescent paste 84 dropped into each square cell defined by the rib 80 tends to flow out of the square cell, as indicated by the arrows in FIG. 1A, through the gap 82, and then brought into contact with the anode 86 or fluorescent layer 12 located in the adjacent cell, causing problematic short-circuiting between the anodes 86 adjacent to each other, or between the anode 86 and the fluorescent layer 88 adjacent to each other. Namely, the conventional fluorescent display tube suffers from a risk of short-circuiting between segments located in the respective cells which are adjacent to each other. It is noted that the term "segment" may be interpreted to mean either of the anode and fluorescent layer in the following description.

SUMMARY OF THE INVENTION

It is therefore a first object of the present invention to provide a fluorescent display tube in which each pair of segments adjacent to each other are prevented from being shorted to each other due to fluidity of the fluorescent material or paste. This first object may be achieved according to any one of first through fifth aspects of the invention which are described below.

It is a second object of the invention to provide a method of manufacturing the fluorescent display tube having the above technical advantage. This second object may be achieved according to any one of sixth through tenth aspects of the invention which are described below.

The first aspect of this invention provides a fluorescent display tube comprising: (a) a substrate having a display surface; (b) anodes formed on the display surface of the substrate, and spaced apart each other; (c) cathodes capable of generating electrons; (d) fluorescent layers each of which is fixed to a corresponding one of the anodes; (e) a partition or rib formed on the display surface of the substrate so as to surround a periphery of each of the fluorescent layers; and (f) a control electrode fixed to an upper end face of the rib, and consisting of a plurality of sections which are spaced apart each other; wherein the fluorescent layers are selectively activated by the control electrode, so as to be struck by the electrons generated by the cathodes, for emitting light, wherein the rib includes continuous wall portions continuously extending along respective boundaries each of which is located between a corresponding pair of the anodes which are adjacent to each other, such that each pair of the anodes are electrically insulated from each other, and wherein the continuous wall portions include portions each of which extends between a corresponding pair of the sections of the control electrode which are adjacent to each other and which are spaced apart from each other.

In the fluorescent display tube defined in this first aspect of the invention, the partition or rib includes the continuous wall portions continuously extending along the respective boundaries, and the continuous wall portions include portions each of which extends between a corresponding pair of the sections of the control electrode which are adjacent to each other and which are spaced apart from each other. In the thus constructed fluorescent display tube, there does not exist a channel electrically connecting each adjacent pair of the segments, i.e., each adjacent pair of the anodes or each adjacent pair of the fluorescent layers, whereby each adjacent pair of the segments are electrically insulated from each other by the corresponding continuous wall portion of the rib. That is, owing to this arrangement, a short-circuiting between the segments due to fluidity of the fluorescent paste is advantageously prevented.

According to the second aspect of the invention, in the fluorescent display tube defined in the first aspect of the invention, the rib consists of a lower portion having a height substantially equal to or not smaller than a height of each of the fluorescent layers, and an upper portion superposed on the lower portion and providing the upper end face of the rib, and wherein the lower portion includes the continuous wall portions, while the upper portion consists of a plurality of sections which are spaced apart from each other, the plurality of sections of the control electrode being fixed to the respective sections of the upper portions. It is noted that the term "height" may be interpreted to mean a distance as measured from a certain level, e.g., the display surface of the substrate, in a direction perpendicular to the display surface.

According to the third aspect of the invention, in the fluorescent display tube defined in the second aspect of the invention, the control electrode has substantially the same configuration as the upper portion of the rib. The fluorescent display defined in the second or third aspect of the invention is advantageously manufactured in accordance with the method defined in the eighth aspect of the invention which is described below.

According to the fourth aspect of the invention, in the fluorescent display tube defined in the second or third aspect of the invention, the height of the lower portion including the continuous wall portions is not smaller than that of each of the fluorescent layers.

According to the fifth aspect of the invention, in the fluorescent display tube defined in any one of the first through fourth aspects of the invention, wherein the fluorescent layers are arranged along two directions which are not parallel to each other, for thereby forming an image in a matrix of dots. The principle of the present invention is advantageously applied to a dot-matrix type fluorescent display tube as defined in this fifth aspect of the invention in which the fluorescent layers should be arranged with high density. In such a dot-matrix type fluorescent display tube in which the spacing interval between each adjacent pair of the fluorescent layers should be minimized for the convenience of the quality of the formed image, it is not desirable to provide a plurality of walls of the rib between each adjacent pair of the fluorescent layers. Thus, it is necessary to provide only a single common control electrode for serving commonly for both of the adjacent pair of adjacent fluorescent layers, such that the control electrode is constituted by a plurality of sections which are spaced apart each other with a certain amount of gap between each adjacent pair of the plurality of sections. In spite of such a requirement as to the arrangement of the control electrode, a short-circuiting between each adjacent pair of segments is advantageously prevented by application of the principle of the present invention.

The sixth aspect of the invention provides a method of manufacturing a fluorescent display tube including: (a) a substrate having a display surface; (b) anodes formed on the display surface of the substrate, and spaced apart each other; (c) cathodes capable of generating electrons; (d) fluorescent layers each of which is fixed to a corresponding one of the anodes; (e) a rib formed on the display surface of the substrate so as to surround a periphery of each of the fluorescent layers; and (f) a control electrode fixed to an upper end face of the rib, and consisting of a plurality of sections which are spaced apart each other; wherein the fluorescent layers are selectively activated by the control electrode, so as to be struck by the electrons generated by the cathodes, for emitting light, and wherein the rib consists of a lower portion and an upper portion which is superposed on the lower portion. The method comprises: (i) a lower-layer forming step of forming the lower portion of the rib on the display surface on which the anodes are formed in a predetermined pattern, such that the lower portion includes continuous wall portions continuously extending along respective boundaries each of which is located between a corresponding pair of the anodes which are adjacent to each other, and such that the continuous wall portions include portions each of which extends between a corresponding pair of the sections of the control electrode which are adjacent to each other and which are spaced apart from each other; (ii) a fluorescent-layer forming step of forming the fluorescent layers, by dropping a fluorescent paste onto the anodes in a printing operation; (iii) an upper-layer forming step of forming the upper portion of the rib, by applying an insulator paste onto the lower portion after the fluorescent layers have been formed; and (iv) a control-electrode forming step of forming the control electrode, by applying a conductor paste onto the upper end face of the upper portion of the rib in a predetermined such that each pair of the plurality of sections of the control electrode adjacent to each other are spaced apart from each other by a predetermined amount of gap.

In the present method, the lower portion of the rib is formed on the display surface of the substrate such that the continuous wall portions of the lower portion continuously extending along the respective boundaries in the lower-layer forming step, and the fluorescent paste is then dropped onto the anodes in the fluorescent-layer forming step. That is, the fluorescent paste is dropped onto each of the anodes which is separated from the adjacent anode by the corresponding continuous wall portion of the lower portion. Since each continuous wall portion has no channel formed therein to permitting flow of the fluorescent paste between each adjacent pair of the anodes, such a flow of the fluorescent paste is advantageously avoided. Further, since the control electrode is formed on the upper end face of the upper portion of the rib which has been formed after the formation of the fluorescent layer, the fluorescent layer and the control electrode are reliably separated and insulated from each other even if the fluorescent paste adheres to the upper end face of the lower portion of the rib in the formation of the fluorescent layer. Thus, a short-circuiting between the adjacent segments due to fluidity of the fluorescent paste is advantageously prevented.

According to the seventh aspect of the invention, in the method defined in the sixth aspect of the invention, the upper portion of the rib is formed such that the upper portion consists of a plurality of sections which are spaced apart from each other.

According to the eighth aspect of the invention, in the method defined in the sixth or seventh aspect of the invention, the insulator paste is applied onto the lower portion in a predetermined pattern that is identical with the predetermined pattern in which the conductor paste is applied onto the upper end face of the upper portion of the rib. In other words, the upper-layer forming step is implemented to form the upper portion of the rib by applying the insulator paste onto the lower portion in a predetermined pattern such that the upper portion consists of a plurality of sections and such that each adjacent pair of the plurality of sections are spaced apart from each other by a predetermined amount of gap, and the control-electrode forming step is then implemented to form the control electrode by applying the conductor paste on the upper end face of the upper portion in the same pattern as the predetermined pattern in which the insulator paste is applied onto the lower portion for forming the upper portion of the rib.

In the method defined in this eighth aspect of the invention, the upper portion of the rib and the control electrode are formed in the same pattern, namely, the upper portion and the control electrode are formed to have substantially same configuration. Therefore, even if there is some degree of misalignment between the lower portion of the rib and the control electrode, such a misalignment does not cause a reduction in area of surface to which the conductor paste forming the control electrode is to be fixed. That is, when the insulator paste is applied to the upper end face of the lower portion of the rib for forming the first layer of the upper portion, the cross sectional area of the first formed layer would be reduced due to the misalignment of the aperture pattern for the formation of the upper portion with respect to the upper end face of the lower portion. However, the cross sectional area of the upper portion is gradually restored or increased as the following layers are successively laminated, so that the upper portion eventually has an upper end face whose area corresponds to that of the aperture pattern when all the layers are laminated. In other words, the misalignment of the aperture pattern for the upper portion with respect to the upper end face of the lower portion is absorbed during the laminations of the layers of the upper portion of the rib. Thus, it is possible to advantageously prevent a reduction in the quality of the formed image due to the arrangement in which the rib and the control electrode are formed by using the respective different patterns.

According to the ninth aspect of the invention, in the method defined in the sixth or seventh aspect of the invention, the insulator paste is applied onto the lower portion in a predetermined pattern that is identical with the predetermined pattern in which the lower portion is formed on the display surface.

According to the tenth aspect of the invention, in the method defined in any one of the sixth through ninth aspect of the invention, the lower portion is formed by laminating two or three layers of an insulator paste.

In the method defined in this tenth aspect of the invention, it is possible to easily adapt the lower portion of the rib to have a sufficient thickness for preventing flowing of the fluorescent paste out of each of the cells, without considerably increasing the thickness so that the upper portion, i.e., the rest portion of the rib can have a thickness sufficiently large for preventing a reduction in the quality of the formed image due to the arrangement in which the rib and the control electrode are formed in the respective different patterns.

BRIEF DESCRIPTION OF THE DRAWINGS

The above and other objects, features, advantages and technical and industrial significance of this invention will be better understood by reading the following detailed description of the presently preferred embodiments of the invention, when considered in connection with the accompanying drawings, in which.

DETAILED DESCRIPTION OF THE PREFERRED EMBODIMENT

Figure 1A:
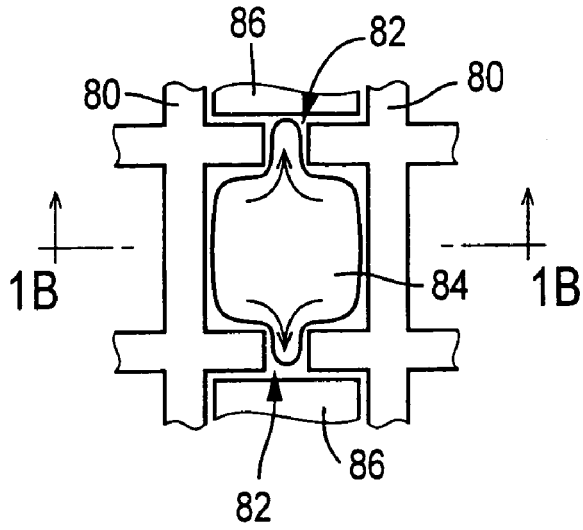
FIG. 1A PRIOR ART
FIG. 1A is a fragmentary top plan view of a conventional fluorescent display tube, showing a drawback experienced in the conventional fluorescent display tube.
Figure 1B:
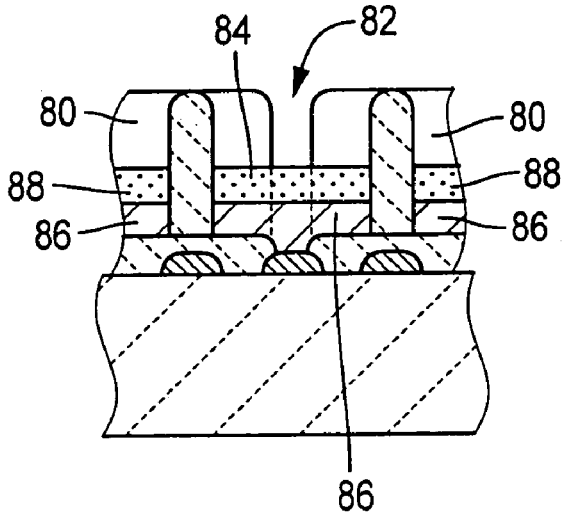
FIG. 1B PRIOR ART
FIG. 1B is a cross sectional view taken along line 1B—1B of FIG. 1A.
Figure 2:
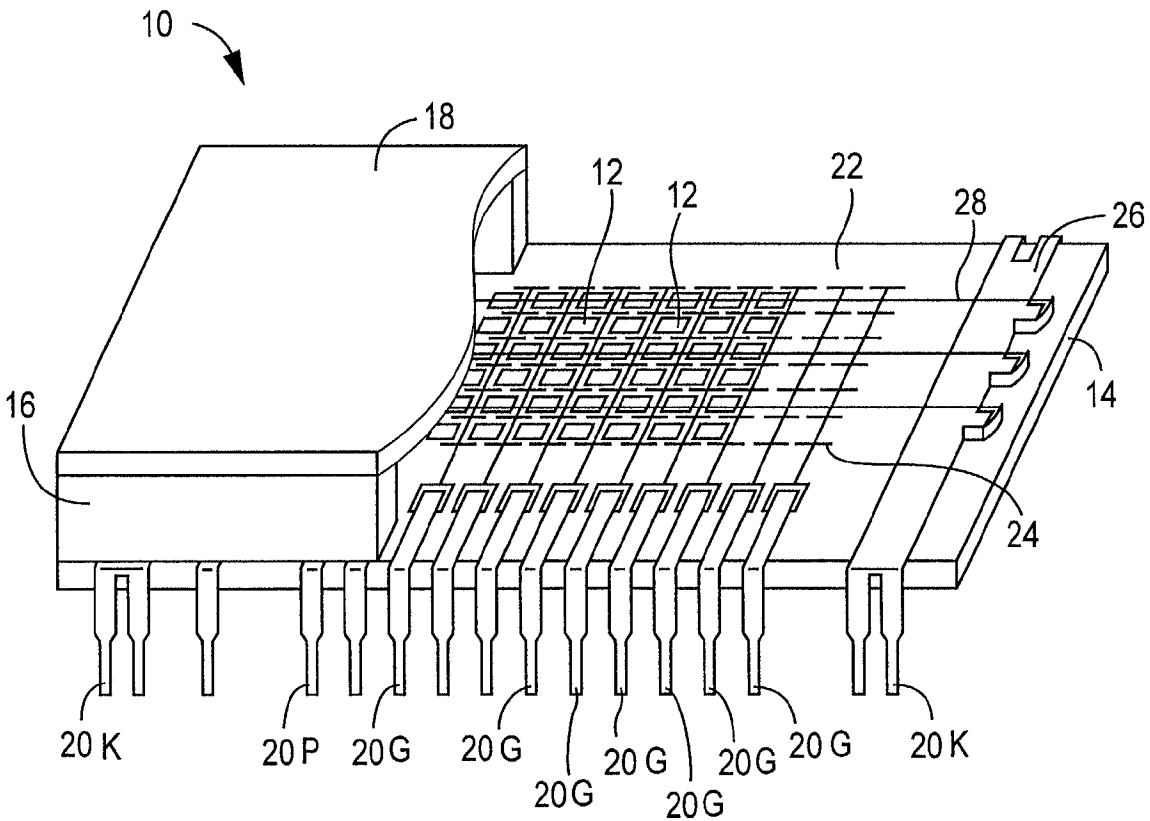
FIG. 2 is a partly cut-away perspective view of a fluorescent display tube which is constructed according to one embodiment of the present invention.

FIG. 2 is a partly cut-away perspective view of a fluorescent display tube 10 which is constructed according to one embodiment of the present invention. The fluorescent display tube 10 includes a substrate 14 which consists of a substantially rectangular plate formed of a suitable glass, ceramic, porcelain enamel or other insulating material or composition. On one 22 of the opposite major surfaces of the substrate 14, a multiplicity of fluorescent layers 12 are formed in a dotted pattern. The display tube 10 further includes: a spacer glass member 16 which has a predetermined height and extends along a peripheral portion of the substrate 14; a transparent covering glass 18; a plurality of anode terminals 20P; a plurality of grid terminals 20G; and a plurality of cathode terminals 20K. The above-described one surface 22 of the substrate 14 is covered by the covering glass 18. The interior space defined by the substrate 14, the spacer glass member 16 and the covering glass 18 is evacuated and fluid-tightly sealed by a suitable sealing glass, whereby a vacuum space, i.e., vacuum fluorescent display tube is provided.

The above-described surface 22 of the substrate 14, covered by the vacuum space, serves as a display surface of the display tube 10. The above-described multiplicity of fluorescent layers 12 arranged in the dotted pattern have respective polygonal shapes which are substantially identical with each other. In the present embodiment, as shown in FIG. 2, each of the fluorescent layers 12 has a rectangular shape whose side extending in a longitudinal direction of the substrate 14 has a length of about 400 μm, and whose side extending in a width direction of the substrate 14 (that is substantially perpendicular to the longitudinal direction) has also a length of about 400 μm. The fluorescent layers 12 are arranged at a constant spacing pitch as viewed either in the longitudinal direction of the substrate 14 and in the width direction of the substrate 14. On the display surface 22, a gird electrode 24 having a lattice construction is provided. The grid electrode 24 consists of a plurality of sections which substantially identical in shape with each other. Each of the fluorescent layers 12 is surrounded over a major portion of its entire periphery by the grid electrode 24. Each of the plurality sections of the grid electrode 24 is elongated in the width direction of the substrate 14. The sections of the grid electrode 24 are spaced apart from each other in the longitudinal direction of the substrate 14. In the present embodiment, the grid electrode 24 serves as a control electrode for controlling activation of the fluorescent layers 12.

To respective longitudinally opposite end portions of the substrate 14, there are fixed a pair of filament support frames 26, each of which includes the above-described cathode terminals 20K. In FIG. 2, a right-side one of the filament support frames 26 is shown while a left-side one of the frames 26 is not shown. A plurality of wires or filaments 28, serving as directly heated cathodes, are provided to be supported and strained by the pair of filament support frames 26. The plurality of filaments 28 extend between the filament support frames 26 in a direction parallel with the longitudinal direction of the substrate 14, and are held at predetermined height positions so as to be spaced apart from the display surface 22 in a direction perpendicular to the display surface 22. The direction in which the filaments 28 extend corresponds to a longitudinal direction of the grid electrode 24. The grid electrode 24 is divided into the above-described sections which are spaced apart from each other in the longitudinal direction of the grid electrode 24, i.e., in the longitudinal direction of the substrate 14. The above-described interior space defined by the substrate 14, the spacer glass member 16 and the covering glass 18 is evacuated through an evacuation hole (not shown), and is then sealed by enclosing the evacuation hole. After the interior space has been evacuated and sealed, the degree of vacuum in the interior space is maintained by a degasser or getter (not shown).

Figure 3:
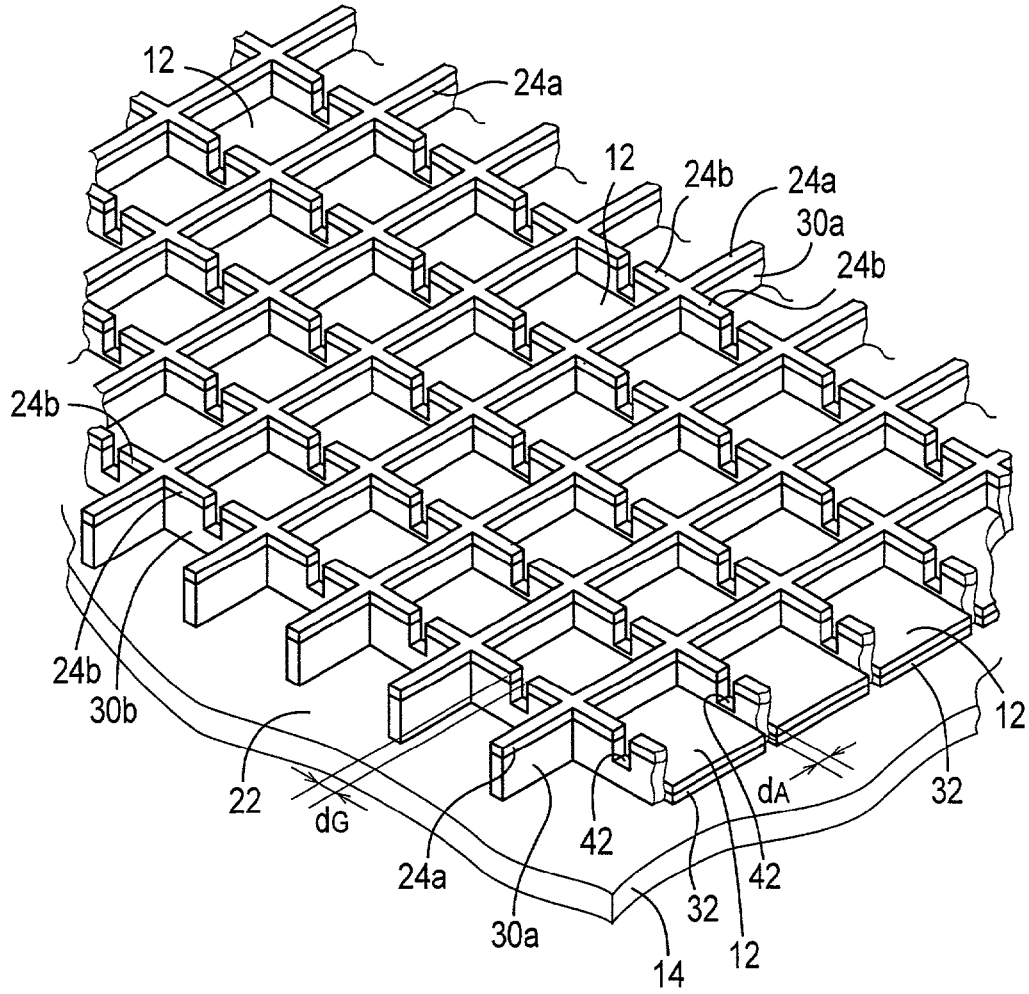
FIG. 3 is a fragmentary perspective view of a display surface of the fluorescent display tube of FIG. 2.

FIG. 3 is a fragmentary perspective view of the display surface 22 of the substrate 14. As is apparent from FIG. 3, a partition or rib 30 having a lattice construction is formed on the display surface 22 such that each of the fluorescent layers 12 is surrounded by the rib 30, namely, such that each of the fluorescent layers 12 is held in contact at its peripheral surface with the rib 30. The rib 30 protrudes in a direction away from the substrate 14 toward the filaments 28 which are held at the predetermined height positions so as to be spaced apart from the display surface 22. The rib 30 is made of an insulating material such as a glass material which includes alumina particles or other inorganic filler and which has a relatively low melting point. The rib 30 has a wall thickness of about 60–150 μm (as measured in the longitudinal direction or width direction of the substrate 14), and a height of about 60–300 μm (as measured in the direction perpendicular to the display surface 22 of the substrate 14) which is larger than the height of the upper surfaces of the fluorescent layers 12. The grid electrode 24 is provided by a thick film which consists principally of particles of an electrically conductive material such as graphite, silver, palladium, copper, aluminum and nickel, and is formed on the upper end face of the rib 30 so as to have a height or thickness of about 5–50 μm, for example, about 20 μm. That is, in the present embodiment, the control electrode has a so-called rib-grid structure in which the grid electrode 24 is disposed on the upper end face of the rib 30 so that the grid electrode 24 is electrically insulated from the fluorescent layers 12 by the rib 30.

As shown in FIG. 3, the rib 30 has widthwise extending portions 30*a* which extend in the width direction of the substrate 14, and lengthwise extending portions 30*b* which extend in the longitudinal direction of the substrate 14. Each of the widthwise extending portions 30*a* consists of a wall whose height is constant as viewed in the width direction of the substrate 14, while each of the lengthwise extending portions 30*b* consists of a wall whose height is not constant as viewed in the longitudinal direction of the substrate 14 due to provision of a plurality of slits or slots 42 formed in each lengthwise extending portion 30*b*. The slots 42 are formed in the upper end face of each lengthwise extending portion 30*b* so as to have a predetermined depth as measured downwardly from the upper end face. Each of the plurality of sections of the grid electrode 24, which is bonded to the upper end face of the rib 30, has a trunk portion 24*a* and a plurality of branch portions 24*b*. The trunk portion 24*a* of each section of the grid electrode 24 extends in the width direction of the substrate 14, and is parallel with the trunk portions 24*a* of the other sections of the grid electrode 24. The branch portions 24*b* extend in the longitudinal direction of the substrate 14 and are parallel with each other. Each of the branch portions 24*b* interests at its intermediate portion with the trunk portion 24*a* at a right angle. That is, each of the sections of the grid electrode 24 continuously extends over the entire width of the grid electrode 24. In other words, the width of the grid electrode 24 is provided by any one of the sections of the grid electrode 24, while the length of the grid electrode 24 is provided by cooperation of the sections which are arranged and spaced apart from each other in the longitudinal direction of the grid electrode 24 or in the longitudinal direction of the substrate 14. The sections of the grid electrode 24 are thus electrically insulated from each other in the longitudinal direction of the substrate 14. A gap $d_G$ between the branch portions 24*b* of the respective sections of the grid electrode 24, which are adjacent and opposed to each other, may be of about 100 μm. Each of the above-described slots 42 is positioned between the opposed and adjacent branch portions 24*b* of the respective sections of the grid electrode 24. It is noted that the plurality of branch portions 24*b* of each section are arranged at a constant spacing pitch in a longitudinal direction of the trunk portion 24*a*, i.e., in the width direction of the substrate 14, and that each of the branch portions 24*b* extends from the corresponding trunk portion 24*a* in opposite directions (parallel with a width direction of the truck portion 24*a*, i.e., with the longitudinal direction of the substrate 14) over a substantially constant distance.

Each of the fluorescent layers 12 is surrounded over a major portion of its entire periphery by a corresponding pair of the sections of the grid electrode 24 which are located in opposite sides of each fluorescent layer 12 in the longitudinal direction of the substrate 14. That is, each fluorescent layer 12 is surrounded over almost the entirety of its periphery by the trunk portions 24*a* and the branch portions 24*b* of the corresponding pair of the sections of the grid electrode 24. However, each fluorescent layer 12 is not completely surrounded by the sections of the grid electrode 24, namely, is not surrounded over its entire periphery by the sections of the grid electrode 24. In contrast to the grid electrode 24 which consists of the sections spaced apart from each other, the rib 30 is adapted to completely surround each fluorescent layer 12. Described more specifically, not only the widthwise extending portions 30*a* of the rib 30 but also the length widthwise extending portions 30*b* of the rib 30 have continuous wall portions each of which continuously extends along a boundary between each adjacent pair of the fluorescent layers 12. Thus, each lengthwise extending portion 30*b* of the rib 30 continuously extends even at the gap $d_G$ by which each adjacent pair of the sections of the grid electrode 24 are spaced apart from each other, i.e., even at each slot 42 which is formed in the upper end face of each lengthwise extending portion 30*b* of the rib 30. Further, each slot 42 has the depth which is determined such that the bottom of each slot 42 has a larger height than each fluorescent layer 12, so that each fluorescent layer 12 is surrounded over its entire periphery and thickness by the rib 30. It is noted that each fluorescent layer 12 is held in close contact at its periphery with an inner circumferential surface of a corresponding one of square cells defined by the rib 30 having the lattice construction so that a spacing interval $d_A$ between each adjacent pair of the fluorescent layers 12 corresponds to thickness of the trunk portion 24*a* and the branch portion 24*b* of the grid electrode 24. This spacing interval $d_A$ between each adjacent pair of the fluorescent layers 12 may be, for example, of about 60–150 μm.

On the display surface 22 of the substrate 14, there is provided a plurality of anodes 32, as is apparent from FIG. 3 in which a cross section of each of the anodes 32 is shown. These anodes 32 are disposed below the respective fluorescent layers 12 which are fixed to upper faces of the anodes 32. Each of the anodes 32 consists of a graphite layer having a thickness of about 30–40 μm. Like each fluorescent layer 12, each anode 32 has a rectangular shape whose side extending in the longitudinal direction of the substrate 14 has a length of about 400 μm, and whose side extending in the width direction of the substrate 14 has also a length of about 400 μm. The above-described continuous wall portion of the rib 30 continuously extends along the boundary between each adjacent pair of the anodes 32, such that each adjacent pair of the anodes 32 are separated from each other by the rib 30 so as to be electrically insulated from each other.

Each fluorescent layer 12, fixed to the corresponding anode 32, is formed of a fluorescent material corresponding to a desired luminescent color. Alternatively, two or more groups of fluorescent layers 12 are formed of respective different fluorescent materials corresponding to respective desired luminescent colors. Each fluorescent layer 12 has a predetermined thickness of about 30 μm which is determined depending upon the desired luminescent color. Where at least two different fluorescent materials are used to form the fluorescent layers 12, for example, where a color display uses three colors, i.e., R (red), G (green), B (blue), the fluorescent layers 12 are disposed in so-called "stripe arrangement" or "quartet arrangement". In the stripe arrangement, a plurality of sets of three fluorescent layers 12 are arranged along each line extending the longitudinal direction of the substrate 14, such that each set consists of three fluorescent layers 12 which are formed of respective different fluorescent materials corresponding to the primary three colors R, G, B and which are arranged at respective successive positions in each line. In the quartet arrangement, a plurality of sets of four fluorescent layers 12 are arranged in 2×2 matrix such that each set consists of three fluorescent layers which are formed of respective different materials corresponding to the three primary colors R, G, B and one additional fluorescent layer 12 formed of the fluorescent material for the color G, and such that the two fluorescent layers 12 are disposed at respective two adjacent positions in a line, while the other two fluorescent layers 12 are disposed at respective two adjacent positions in the next line, which positions lie in respective two rows corresponding to the two positions of the two fluorescent layers 12 in the preceding line. In the stripe arrangement, each set of the three fluorescent layers 12 arranged adjacent to each other in each line constitutes one picture element. In the quartet arrangement, each set of the four fluorescent layers 12 arranged in the 2×2 matrix constitutes one picture element.

Figure 4A:
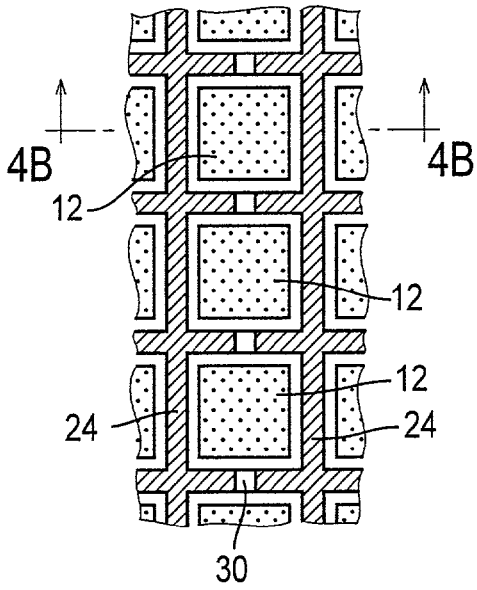
FIG. 4A is a fragmentary top plan view of the display surface of the fluorescent display tube of FIG. 2.
Figure 4B:
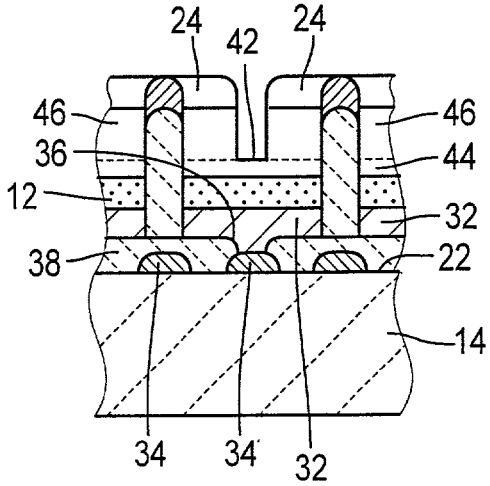
FIG. 4B is a cross sectional view taken along line 4B—4B of FIG. 4A.

FIG. 4A is a top plan view of a portion of the display surface 22 of the fluorescent display tube 10, while FIG. 4B is a cross sectional view taken along line 4B—4B of FIG. 4A, showing an electrode arrangement on the substrate 14. For easier understanding, it is described in FIG. 4A as if each fluorescent layer 12 were not held in contact at its periphery with the inner circumferential surface of the corresponding square cell defined by the rib 30 having the lattice construction. On the display surface 22 of the substrate 14, there is provided an anode wiring 34 which consists of a plurality of strips connected to the above-described anode terminals 20P. The anode wiring 34 is formed in a screen printing operation in which a thick-film conductor paste is printed to have a thickness of about 15 μm in a pattern of the plurality of strips and the printed past is then fired, or alternatively, in vapor-deposition and etching operations in which an aluminum thin layer is first formed by vapor deposition and the formed layer is then patterned into the plurality of strips by etching. On the thus formed anode wiring 34, there is formed an insulating layer 38 which has a predetermined thickness and covers substantially the entirety of the display surface 22. The insulating layer 38 has through-holes 36 formed therethrough in a direction of the thickness of the insulating layer 38. This insulating layer 38 is formed in a screen printing operation in which a thick-film insulator paste is printed to have a thickness of about 30–40 μm and the printed pate is then fired. The thick-film insulator paste forming the insulating layer 38 is made of a glass material having a relatively low melting point and also a color pigment.

The anodes 32, which are disposed on the insulating layer 38, are positioned in such positions that permit the anodes 32 to have electrical continuities with the strips of the anode wiring 34 through the above-described through-holes 36. The anodes 32 are formed by printing a thick-film forming paste made principally of a graphite material, in a predetermined dotted pattern and then firing the printed paste. The fluorescent layers 12 are formed by printing a thick-film fluorescent paste on the anodes 32. The rib 30 is formed by printing a thick-film insulator paste around the fluorescent layers 12 and the anodes 32. The rib 30, as well as the anodes 32, is disposed on the insulating layer 38 rather than directly on the display surface 22 of the substrate 14, so that the anode 32 and the fluorescent layer 12 located within each of the square cells are electrically insulated from those located within the adjacent square cell, by the above-described continuous wall potion of the rib 30. The rib 30 consists of a lower portion 44 and a upper portion 46 which is superposed on the lower portion 44, as is apparent from FIG. 4B in which an interface between the upper and lower portions 46, 44 is represented by the broken line. The above-described continuous wall portions are included in the lower portion 44, while the above-described slots 42 are formed in the upper portion 46. The bottom faces of the slots 42 lie on the interface between the upper and lower portions 46, 44. The rib 30 thus consisting of the upper and lower portions 46, 44 is formed by repeatedly printing a thick-film insulator paste made of an insulating material such as a glass material which includes an inorganic filler and which has a relatively low melting point, such that the rib 30 is formed in a predetermined pattern in which the width of each wall of the lattice construction of the rib 30 is about 60–150 μm. The thus formed rib 30 has a height of about 60–300 μm as measured from the surface of the insulating layer 38, and a height of about 30–250 μm as measured from the surface of the fluorescent layer 12. The lower portion 44 of the rib 30 has a height or thickness of about 40–60 μm. The difference between the heights of the entire rib 30 and the lower portion 44 corresponds to the height of the upper portion 46. The grid electrode 24 is formed on the upper end face of the rib 30 so as to have a thickness of about 5–50 μm, by printing a thick-film conductor paste which includes particles of an electrically conductive material such as silver, palladium, aluminum, nickel and carbon.

In operation of the fluorescent display tube 10 constructed as described above, an accelerating voltage (positive voltage) of about 20V (with respect to 0V of the filament cathodes) is applied between the filament cathodes 28 and selected pair of the sections of the grid electrode 24 which are adjacent to each other. While the filament cathodes 28 are constantly heated with application of a predetermined amount of current thereto, the selected pair of the sections of the grid electrode 24 are successively changed such that a scanning is effected in the downward direction as seen in FIG. 4A, for example. In this instance, the successive change of the selected pair of the grid electrode sections is made such that the currently selected pair of the grid electrode sections consists of a section which is newly selected and a section which consists of one of the last selected pair. Further, in synchronization with the scanning, a driving voltage (positive voltage) of about 20V, for example, which is equal to the above-described accelerating voltage, is applied to selected ones of the strips of the anode wiring 34 which are selected according to input data. As a result, thermoelectrons generated or liberated from the filament cathodes 28 are accelerated by the currently selected sections of the grid electrode 24 to which the accelerating voltage is being applied, and then strike ones of the fluorescent layers 12 which are surrounded by the currently selected sections of the grid electrode 24, so that those ones of the fluorescent layers 12 emit light. However, no light is emitted from these fluorescent layers 12 even where the positive voltage is being applied to these fluorescent layers 12 through the respective anodes 32, if a cutoff bias voltage (negative voltage) of about several volts to 10V (with respect to 0V of the filament cathodes) is being applied to the sections of the grid electrode 24 which surround these fluorescent layers 12. This is because the application of the cutoff bias voltage to the sections of the grid electrode 24 impedes arrival of the thermoelectrons to the fluorescent layers 12. That is, in the present fluorescent display tube 10 which is of a dynamically driven type, while the thermoelectrons are being liberated by application of the current to the filament cathodes 28, the positive voltage is applied to desired ones of the fluorescent layers 12, in synchronization with the sequential connection of the grid electrode 24 to the accelerating voltage line, so that desired characters such as letters and symbols, and graphical representations are displayed.

Figure 5:
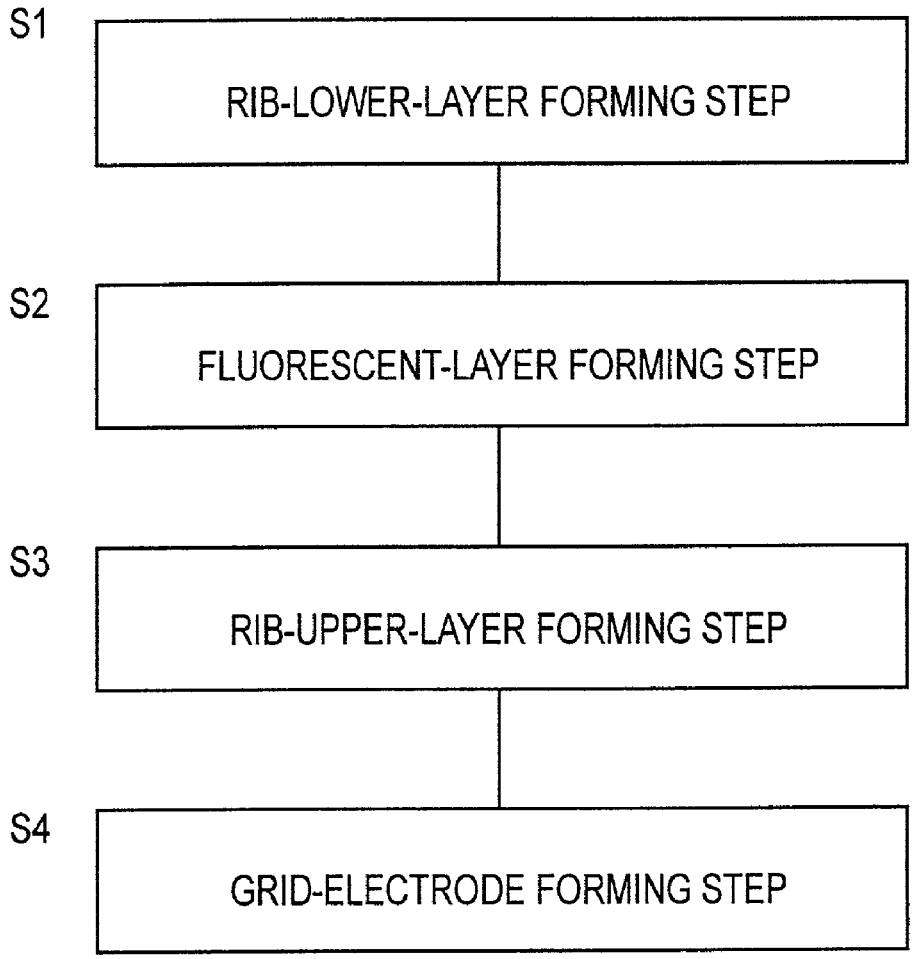
FIG. 5 is a flow chart illustrating a process for manufacturing an anode substrate of the fluorescent display tube of FIG. 2.
Figure 6:
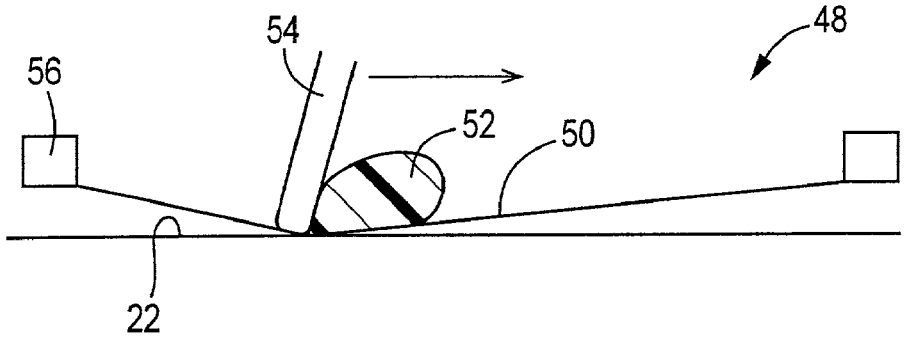
FIG. 6 is a view schematically showing a screen printing operation executed in the manufacturing process of FIG. 5.

The above-described rib 30, fluorescent layers 12 and grid electrode 24 may be manufactured in accordance with a process illustrated by the flow chart of FIG. 5. After the formations of the anode wiring 34, insulating layer 38 and anodes 32 on the substrate 14 in the order of description, a rib-lower-layer forming step S1 is implemented to form the lower portion 44 of the rib 30 on the insulating layer 38 such that each of the anodes 32 is surrounded by the lower portion 44. This step S1 is carried out by a screen printing operation, as schematically shown in FIG. 6, in which a squeegee 54 is slidably moved in a predetermined direction on a surface of a mask screen 50 of a screen assembly 48 which is disposed on the substrate 14, for forcing a print material in the form of a thick-film insulator paste 52 into apertures of the mask screen 50, so as to print the insulator paste 52 on the insulating layer 38. It is noted that the screen assembly 48 consists of the mask screen 50 and also a rectangular holding frame 56 to which the mask screen 50 is fixed at its peripheral portion by an adhesive or other suitable means.

Figure 7A:
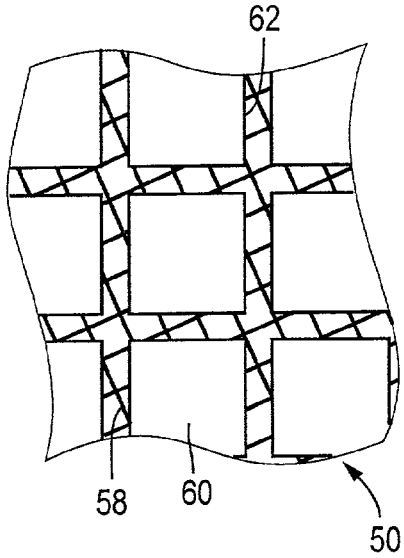
FIG. 7A is a fragmentary top plan view of a mask screen which is used in a rib-lower-layer forming step S1 in the manufacturing process of FIG. 5.

The mask screen 50 consists of a mesh 58 which is woven from vertical and horizontal threads in the form of a metallic wire such as stainless steel or a resin wire such as tetron, and also a resin layer 60 which is fixed to a surface of the mesh 58, as shown in FIG. 7A. The resin layer 60 has a thickness of about 10–200 μm, and is formed of a photosensitive resin having a mechanical strength which is increased by polymerization owing to its exposure. The resin layer 60 serves as a resist layer to inhibit penetration of the insulator paste 52 through the mask screen 50 during the printing operation. FIG. 7A shows a printing region (a region through which the insulator paste 52 penetrates) in a central portion of the mask screen 50. The printing region, which is provided by a latticed opening or aperture 62, is obtained by removing a portion or portions of the resin layer 60 in a predetermined pattern after the exposure of the resin layer 60.

In the rib-lower-layer forming step S1, the screen printing operation using the mask screen 50 and a drying operation following the screen printing operation are repeated a predetermined number of times, for example, two or three times, and the applied paste is subjected to a heat treatment at a predetermined firing temperature, whereby the lower portion 44 of the rib 30 is formed. The number of times may be determined suitably depending upon various factors such as the thickness of the lower portion 44, the viscosity of the applied paste and the thickness of the mask screen.

The rib-lower-layer forming step S1 is followed by a fluorescent-layer forming step S2 which is also carried out by a screen printing operation in which the fluorescent layers 12 are formed with application of a fluorescent paste, by using a mask screen having an aperture pattern substantially opposite to that of the mask screen 50 which is used in the step S1. In this step S2, the fluorescent paste is dropped into each of the square cells defined by the lower portion 44 of the rib 30, namely, onto each of the anodes 32 in the screen printing operation, and the fluorescent paste is then dried and fired with application of a suitable heat treatment, so that the fluorescent layers 12 are formed. Where at least two different kinds of materials are used as the fluorescent paste, the screen printing operation may be repeated a number of times which number is determined depending upon the kind of material of the applied paste.

Since the formation of the lower portion 44 of the rib 30 is effected by using the mask screen 50 having the aperture pattern as shown in FIG. 7A, each of the anodes 32 on which the fluorescent layers 12 are disposed is surrounded over the entirety of its periphery by the formed lower portion 44, thereby eliminating a risk of flowing of the fluorescent paste out of each of the square cells which is completely surrounded by the lower portion 44. Further, as is apparent from FIGS. 3 and 4, the lower portion 44 is adapted to have a height sufficiently larger than that of the surface of each fluorescent layer 12, it is also possible to prevent the fluorescent paste from getting over the upper end of the lower portion 44, whereby the flowing of the fluorescent paste out of each square cell is more reliably prevented. Thus, the fluorescent paste applied into each square cell is prevented from being brought into contact with the anode 32 and fluorescent layer 12 disposed in the adjacent square cell, thereby eliminating a risk of short-circuiting between the segments located in the respective cells.

Figure 7B:
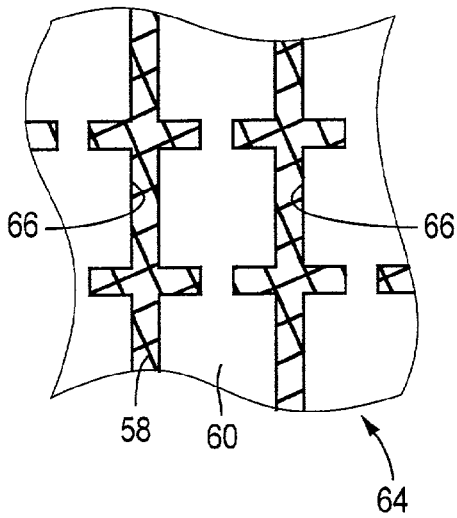
FIG. 7B is a fragmentary top plan view of a mask screen which is used in a rib-upper-layer forming step S3 in the manufacturing process of FIG. 5.

The fluorescent-layer forming step S2 is followed by a rib-upper-layer forming step S3 which is implemented to form the upper portion 46 of the rib 30 by using a thick-film insulator paste that is similar to the insulator paste used for the formation of the lower portion 44. In this step S3, a screen assembly having a mask screen 64, as shown in FIG. 7B, is used in place of the screen assembly 48 that is used for the formation of the lower portion 44. The mask screen 64 is different from the mask screen 50 in that an opening or aperture 66 consists of a plurality of sections which are spaced apart each other. The plurality of sections of the aperture 66 are arranged in the horizontal direction as seen in FIG. 7B, with a certain amount of gap between each pair of the sections which are adjacent to each other in the horizontal direction. The insulator paste is repeatedly applied by using the thus constructed mask screen 64, and is then subjected to a heat treatment, whereby the upper portion 46 consisting of a plurality of sections spaced apart from each other is formed to cooperate with the lower portion 44 to provide the rib 30 having the slots 42. The upper end face of the rib 30 is positioned upwardly of the upper end of each of the fluorescent layers 12. Even if the fluorescent paste adhered to the upper end face of the lower portion 44 in the formation of the fluorescent layers 12, such an upper end face of the lower portion 44 is covered with the upper portion 46 whose upper end face is free of the fluorescent paste.

After the rib 30 and the fluorescent layers 12 have been formed as described above, a grid-electrode forming step S4 is implemented to apply a thick-film conductor paste on the upper end face of the rib 30, by using still the screen assembly equipped with the above-described mask screen 64. The applied conductor paste is subjected to a suitable heat treatment, whereby the grid electrode 24 consisting of the plurality of sections is formed such that each adjacent pair of the sections of the grid electrode 24 is spaced apart from each other by the predetermined gap $d_G$. Since the formation of the upper portion 46 of the rib 30 and the formation of the grid electrode 24 are effected with the same mask screen, i.e., the mask screen 64, it can be said that the upper portion 46 of the rib 30 and the grid electrode 24 are formed in the same pattern.

In the rib-upper-layer forming step S3 in which the upper portion 46 is formed by using the screen assembly different from that used for the formation of the lower portion 44, the aperture 66 of the mask screen 64 is not necessarily accurately aligned with the upper end face of the lower portion 44, because of possible inaccuracy in the positioning of each screen assembly relative to a supporting table or other component of the screen printing machine and/or possible inaccuracy in the formation of the aperture pattern of the mask screen of each screen assembly. However, in spite of such a misalignment between the aperture 66 of the mask screen 64 and the upper end face of the lower portion 44, the insulator paste for forming the upper portion 46 is applied to the lower portion 44 eventually in accordance with the aperture pattern of the mask screen 64 as the printing operation is repeated. That is, the misalignment between the aperture 66 of the mask screen 64 and the upper end face of the lower portion 44 does not cause a undesirable reduction in area of surface to which the conductor paste forming the grid electrode 24 is to be fixed. Further, since the conductor paste for the gird electrode 24 is applied by using the mask screen 64 which is used also for the application of the insulator paste for the upper portion 46, the position and area of the upper end face of the rib 30, namely, the position and area of the surface to which the conductor paste is to be applied, logically coincide with those of the aperture 66 of the mask screen 64 even in the presence of the above-described inaccuracies. Consequently, using the different screen assemblies or mask screens for the respective formations of the lower portion 44 and the grid electrode 24 does not affect the accurate formation of the grid electrode 24 in the desired pattern.

In the fluorescent display tube 10 constructed according to the present embodiment, the lower portion 44 of the rib 30 includes the continuous wall portions continuously extending along the boundaries each of which is located between the adjacent pair of the anodes 32. Some of the continuous wall portions extend along the boundaries in each of which the above-described gap $d_G$ between the adjacent sections of the grid electrode 24 is located, while the other continuous wall portions extend along the boundaries in each of which the gap $d_G$ is not located. In other words, the continuous wall portions include portions each of which extends between a corresponding adjacent pair of the sections of the grid electrode 24 which are spaced apart from each other. That is, the rib 30 extend along all the boundaries between the adjacent anodes 32 irrespective of whether the gap $d_G$ is located or not in each of the boundaries. In this arrangement, there does not exist a channel electrically connecting each adjacent pair of the segments, i.e., each adjacent pair of the anodes 32 or each adjacent pair of the fluorescent layers 12, whereby each adjacent pair of the segments are electrically insulated from each other by the rib 30. That is, owing to this arrangement, a short-circuiting between the segments due to fluidity of the fluorescent paste is advantageously prevented.

In the manufacture of the fluorescent display tube 10, the lower portion 44 of the rib 30 is formed on the display surface 22 of the substrate 14 at the rib-lower-layer forming step S1 such that the continuous wall portion continuously extending along the boundary between each pair of the anodes 32 which are adjacent to each other, and the fluorescent paste is then dropped onto the anodes 32 at the fluorescent-layer forming step S2. That is, the fluorescent paste is dropped onto each of the anodes 32 which is separated from the adjacent anode 32 by the continuous wall portion of the lower portion 44. Since the continuous wall portion of the lower portion 44 has no channel formed therein to permitting flow of the fluorescent paste between each adjacent pair of the anodes 32, such a flow of the fluorescent paste is advantageously avoided whereby a short-circuiting between the segments is prevented.

Further, in the fluorescent display tube 10 of the present embodiment, the rib 30 consists of the lower and upper portions 44, 46, and the upper portion 46 and the control electrode 24 which is disposed on the upper end face of the upper portion 46 are formed by using the same mask screen 64 so that the upper portion 46 and the control electrode 24 are formed to have substantially same configuration. Therefore, even if there is some degree of misalignment between the lower portion 44 and the control electrode 24 which are formed by the respective different mask screens 50, 64, such a misalignment does not cause a reduction in area of surface to which the conductor paste forming the control electrode 24 is to be fixed. Thus, it is possible to advantageously prevent a reduction in the quality of the formed image due to the arrangement in which the rib 30 and the control electrode 24 are formed in the respective different patterns. Particularly, in the present embodiment in which the lower portion 44 is formed by laminating three or less layers of the insulator paste, the thickness of the upper portion 46 can be made large sufficiently for more reliably preventing a reduction in the quality of the formed image due to the misalignment between the mask screens 50, 64.

Further, since the grid electrode 24 is formed on the upper end face of the upper portion 46 of the rib 30 which has been formed after the formation of the fluorescent layers 12, the fluorescent layers 12 and the grid electrode 24 are reliably separated and insulated from each other even if the fluorescent paste had adhered to the upper end face of the lower portion 44 of the rib 30 during the formation of the fluorescent layers 12. Where the fluorescent layers 12 are formed by dropping the fluorescent paste onto the anodes 32 in a screen printing operation after the formation of the lower portion 44 (which serves to prevent flowing of the fluorescent paste out of each square cell), as in the present embodiment, it is preferable that each of the apertures of the mask screen for applying the fluorescent paste has a larger width or dimension than that of the area which is surrounded by an inner circumferential surface of each square cell defined by the rib 30, i.e., onto which the fluorescent paste is to be applied, so that the applied fluorescent paste adheres also to a portion of the upper end face of the lower portion 44 which portion surrounds each square cell. However, in such a case in which the fluorescent paste adheres to the upper end face of the lower portion 44, the fluorescent display tube 10 would suffer from a short-circuiting between the fluorescent layers 12 and the grid electrode 24, if the gird electrode 24 is formed immediately after the formation of the fluorescent layers 12.

Figure 8:
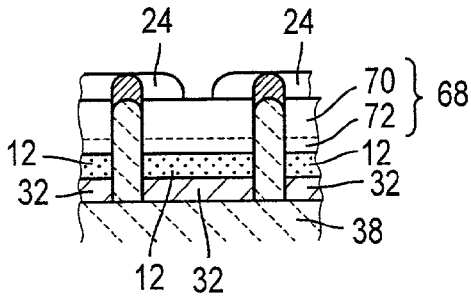
FIG. 8 is a view corresponding to that of FIG. 4B, showing another embodiment of this invention.

FIG. 8 is a cross sectional view corresponding to that of FIG. 4B, and shows a fluorescent display tube which is constructed according to another embodiment of the invention. While the rib 30 has the slots 42 formed in the upper portion 46 in the fluorescent display tube 10 of the above-illustrated embodiment, a rib 68 does not have a slot formed therein and has a height constant over its entirety in this fluorescent display tube. In the manufacture of this display tube, the entirety of the rib 68 is formed by repeatedly applying the insulator paste by using the mask screen 50 which is shown in FIG. 7A, namely, the entirety of the rib 68 is formed in the single pattern, while the grid electrode 24 is formed by applying the conductor paste by using the mask screen 64 which is shown in FIG. 7B. Such a construction of this fluorescent display tube, which is more simple than that of the fluorescent display tube 10, does not provide any inconvenience, for example, where a possible instability in positioning of the mask screens relative to the screen printing machine in the replacement of one of the mask screens 50, 64 with the other does not cause a problematic reduction in the quality of the formed image.

Although the entirety of the rib 68 is formed by using the single mask screen 50, the rib 68 consists of upper and lower portions 70, 72, wherein the lower portion 72 is formed before the formation of the fluorescent layers 12 while the upper portion 70 is formed after the formation of the fluorescent layers 12. In this respect, like the fluorescent display tube 10 of the above-illustrated embodiment, the lower portion 72 serves to prevent flowing of the fluorescent paste out of each square cell, while the upper portion 70 serves to prevent short-circuiting between the fluorescent layers 12 and the grid electrode 24.

While the presently preferred embodiments of this invention have been described in detail, for illustrative purpose only, it is to be understood that the present invention is not limited to the details of the illustrated embodiments, but may be otherwise embodied.

While the fluorescent layers 12 arranged along the two directions which are perpendicular to each other have the rectangular shape in the above-illustrated embodiments, the fluorescent layers 12 may have a hexagonal shape or other polygonal shape, as long as the grid electrode 24 consists of the plurality of sections which are spaced apart from each other. Further, the fluorescent layers 12 may be arranged in such a pattern that facilitates display of particular characters.

In the above-illustrated embodiments, the grid electrode 24 is divided into the plurality of sections such that the divided sections are spaced apart from each other as viewed in the longitudinal direction of the substrate 14 and such that each of the plurality of rows of the fluorescent layers 12 extending in the width direction of the substrate 14 are interposed by and between adjacent pair of the sections of the electrode 24. However, the grid electrode 24 may be otherwise divided into the sections depending upon various factors such as a desired display pattern and a manner of controlling activation of the fluorescent layers 12.

While the lower portion 44 of the rib 30 is formed to have the height larger than that of the surfaces of the fluorescent layers 12 in the above-illustrated embodiments, the height of the lower portion 44 may be smaller than that of the surfaces of the fluorescent layers 12 as long as the height of the lower portion 44 is high enough to prevent flowing of the fluorescent paste out of each square cell.

While the fluorescent layers 12 are formed after the formation of the lower portion 44 including the continuous wall portions in the embodiment shown in FIGS. 2–7, the fluorescent layers 12 may be formed any time after the height of the lower portion 44 has become large enough to prevent flowing of the fluorescent paste out each square cell. Thus, it is possible to form the fluorescent layers 12 even in the process of formation of the lower portion 44.

It is to be understood that the present invention may be embodied with various other changed, modifications and improvements, which may occur to those skilled in the art, without departing from the sprit and scope of the invention defined in the following claims.

What is claimed is:

1. A fluorescent display tube comprising:

a substrate having a display surface;

anodes formed on said display surface of said substrate, and spaced apart from each other;

cathodes capable of generating electrons;

fluorescent layers each of which is fixed to a corresponding one of said anodes, said fluorescent layers being formed by printing a fluorescent paste onto each of said anodes;

a rib formed on said display surface of said substrate, and extending continuously along respective boundaries each of which is located between a corresponding pair of said anodes which are adjacent to each other, so as to surround a periphery of each said fluorescent layers; and a control electrode fixed to an upper end face of said rib;

wherein said fluorescent layers are selectively activated by said control so as to be struck by said electrons generated by said cathodes, for emitting light, wherein said rib includes a lower portion and an upper portion which is superposed on said lower portion and which provides said upper end face, wherein said rib has a plurality of slots opening in said upper end face, such that said upper portion is divided into a plurality of sections by said slots, and such that said control electrode fixed to said upper end face is divided into a plurality of sections by said slots, wherein said lower portion includes paste-flow preventing portions each of which is located below a corresponding one of said plurality of slots and each of which extends between a corresponding pair of said sections of said upper portion adjacent to each other and spaced apart from each other, and wherein each of said paste-flow preventing portions of said lower portion of said rib has a height equal to or not smaller than a height of each of said fluorescent layers, said height of each of said paste-flow preventing portions corresponding to a distance measured from said display surface, and said height of each of said fluorescent layers corresponding to a distance measured from said display surface.

2. A fluorescent display tube according to claim 1, wherein said control electrode has the same configuration as said upper portion of said rib.

3. A fluorescent display tube according to claim 1, wherein said fluorescent layers are arranged along two directions which are not parallel to each other, for thereby forming an image in a matrix of dots.

4. A method of manufacturing the fluorescent display tube recited in claim 1, said method comprising:

a lower-layer forming step of forming said lower portion of said rib on said display surface on which said anodes are formed in a predetermined pattern, such that said lower portion includes said paste-flow preventing portions each of which extends between the corresponding pair of said sections of said upper portion adjacent to each other and spaced apart from each other;

a fluorescent-layer forming step of forming said fluorescent layers on said anode, by printing with said fluorescent paste;

an upper-layer forming step of forming said upper portion of said rib, by applying an insulator paste onto said lower portion after said fluorescent layers have been formed; and a control-electrode forming step of forming said control electrode, by applying a conductor paste onto the upper end face of said upper portion of said rib in a predetermined pattern such that each pair of said plurality of sections of said control electrode adjacent to each other are spaced apart from each other by a predetermined amount of gap.

5. A method according to claim 4, wherein said upper portion of said rib is formed such that said upper portion consists of said plurality of sections which are spaced apart from each other.

6. A method according to claim 4, wherein said insulator paste is applied onto said lower portion in a predetermined pattern that is identical with said predetermined pattern in which said conductor paste is applied onto the upper end face of said upper portion of said rib.

7. A method according to claim 4, wherein said insulator paste is applied onto said lower portion in a predetermined pattern that is identical with said predetermined pattern in which said lower portion is formed on said display surface.

8. A method according to claim 4, wherein said lower portion is formed by laminating two or three layers of an insulator paste.

* * * * *